US007114364B2

(12) United States Patent
Weigelt

(10) Patent No.: US 7,114,364 B2
(45) Date of Patent: Oct. 3, 2006

(54) CAM SLIDER

(76) Inventor: Harald Weigelt, Technologiepark Bergisch Gladbach, Friedrich-Ebert-Strasse, 51429, Bergisch Gladbach (DE)

( * ) Notice: Subject to any disclaimer, the term of this patent is extended or adjusted under 35 U.S.C. 154(b) by 328 days.

(21) Appl. No.: 10/399,198

(22) PCT Filed: Oct. 5, 2001

(86) PCT No.: PCT/EP01/11478

§ 371 (c)(1),
(2), (4) Date: Apr. 11, 2003

(87) PCT Pub. No.: WO02/30659

PCT Pub. Date: Apr. 18, 2002

(65) Prior Publication Data

US 2004/0025561 A1 Feb. 12, 2004

(30) Foreign Application Priority Data

Oct. 13, 2000 (EP) ..... 00122406

(51) Int. Cl.
*B21D 5/04* (2006.01)
*B21D 37/08* (2006.01)
*B21D 28/34* (2006.01)

(52) U.S. Cl. ..... 72/452.9; 72/389.4; 72/462

(58) Field of Classification Search ..... 72/452.9, 72/389.4, 462
See application file for complete search history.

(56) References Cited

U.S. PATENT DOCUMENTS

| | | | | |
|---|---|---|---|---|
| 5,101,705 | A | 4/1992 | Matsuoka | 72/452.9 |
| 5,487,296 | A * | 1/1996 | Gerhart et al. | 72/381 |
| 5,711,180 | A | 1/1998 | Sasahara et al. | 72/452.9 |
| 5,884,521 | A * | 3/1999 | Fidziukiewicz | 72/452.9 |
| 5,904,064 | A | 5/1999 | Higuchi | 72/452.9 |
| 6,164,115 | A * | 12/2000 | Higuchi et al. | 72/452.9 |
| 6,619,095 | B1 * | 9/2003 | Matsuoka | 72/315 |
| 6,889,535 | B1 * | 5/2005 | Ericson | 72/61 |

FOREIGN PATENT DOCUMENTS

| | | |
|---|---|---|
| DE | 197 53 549 | 6/1999 |
| EP | 0 922 509 | 6/1999 |
| GB | 2 342 063 | 4/2000 |

* cited by examiner

*Primary Examiner*—David Jones
(74) *Attorney, Agent, or Firm*—Sutherland Asbill & Brennan LLP

(57) ABSTRACT

The invention relates to a cam slider with an upper guiding part containing a cam element (20) and a cam guiding element (10), and with a lower guiding part containing a driver element (40), the upper guiding part (10, 20) being holdable and/or held together by at least one guiding clamp (30).

21 Claims, 5 Drawing Sheets

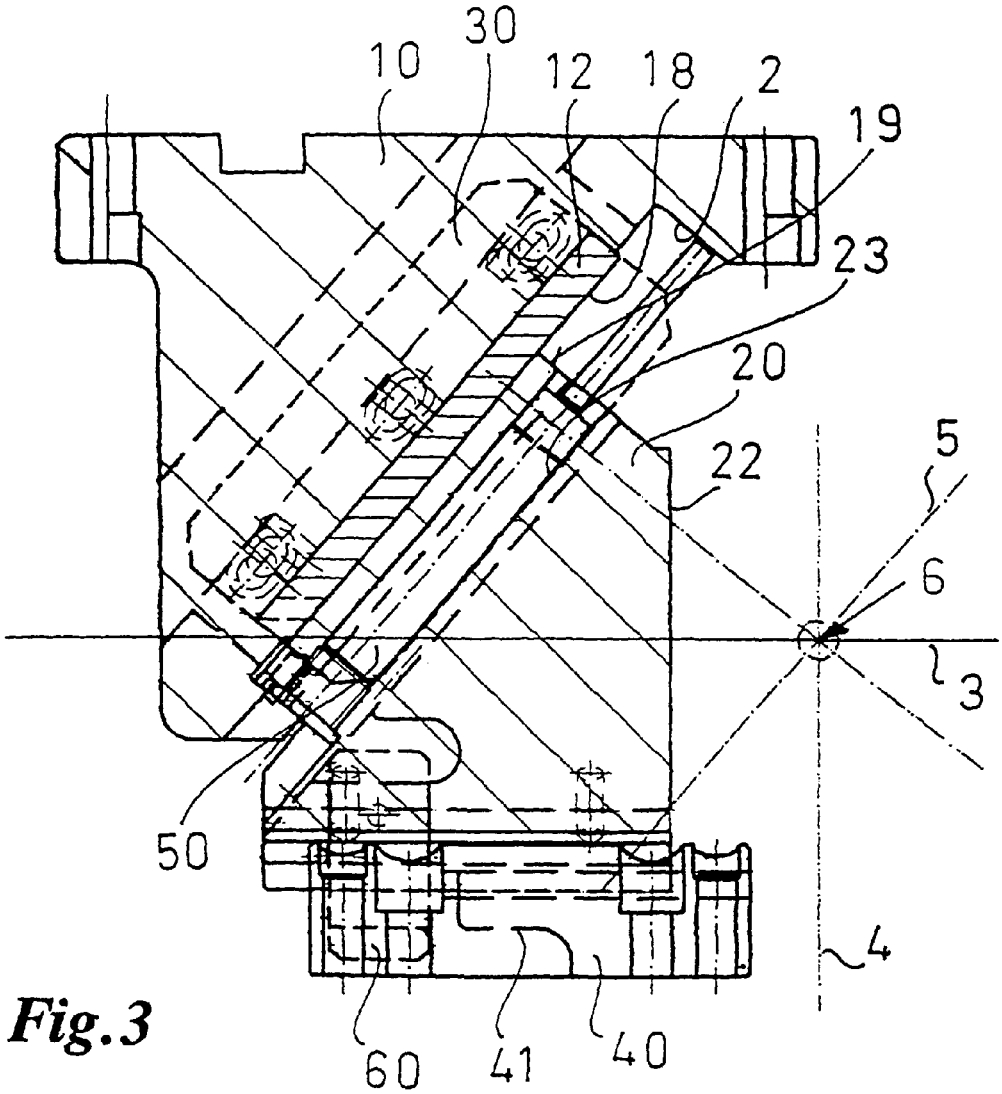
*Fig.3*
*Fig.4*
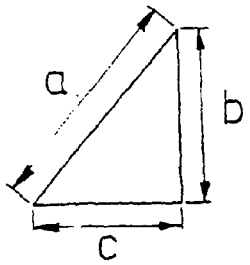

CAM SLIDER

The invention relates to a cam slider with an upper guiding part containing a cam element and a cam guiding element, and with a lower guiding part containing a driver element.

BACKGROUND OF THE INVENTION

Such cam sliders are familiar. They are used especially in tools in metalworking, e.g. presses. Usually connected to the cam sliders are devices permitting punching or some other forming process. The cam sliders are moved by means of the cam guiding element by a drive applying what is generally a vertical pressing force. By means of the driver element, the cam sliders are fastened in the tool or press to a base plate on which the workpiece to be machined is placed directly or on a suitable support element. DE 197 53 549 C2, for instance, describes a cam slider for the deflection of a vertical pressing force that has a driver element with a prismatic surface. Here, the flanks of the prismatic surface fall away outward. Furthermore, positive returns are arranged on two opposite sides in the respective grooves of the cam element and driver element. This therefore ensures that, in the event of the breakage of a spring element returning the cam element to its starting position, the cam element is returned in the event of spring breakage in order to prevent screwed-on punch elements from breaking off. The cam element is fastened to the cam guiding element with guide angles and retaining screws and can be moved along the guide angles relative to the cam guiding element.

U.S. Pat. No. 5,101,705 describes another cam slider on which, however, the cam element is also suspended from guide angles or fastened by means of these to the cam guiding element. For this it is necessary that the plates resting against each other and the elements required for fastening are precisely ground in in order to ensure the running play necessary between the cam element and cam guiding element. In the case of the cam slider disclosed in this publication and also in the case of the other known cam sliders on which the cam guiding element and cam element are connected together by means of guide angles and screws, it proves to be disadvantageous that all the tensile forces are introduced into the screws, as a result of which the running play of the cam guiding element and cam element moving against each other is impaired at the very moment when an expansion of the screws or of the material surrounding them takes place. This subsequently results in diminished stability, as the wear due the twisting of the tool in this area is particularly increased. It also proves to be disadvantageous that the cam element when it warms up cannot expand laterally as it is constricted in this respect by the guide angles. This can also lead to increased wear of the tool and at worst to such reduced running play that the movement of the cam element and cam guiding element against each other becomes virtually impossible.

SUMMARY OF THE INVENTION

The invention therefore is based on the object of eliminating these disadvantages and providing a cam slider whose service life is considerably longer than that of cam sliders of the prior art and on which as little impairment as possible of running play can occur.

Said object is achieved for a cam slider according to the preamble of claim 1, in that the upper guiding part is holdable and/or held together by at least one guiding clamp. Further embodiments of the invention are defined in the dependent claims.

This consequently yields a cam slider on which in particular the cam element and cam guiding element are held together by at least one guiding clamp. As a result it is not necessary to precisely grind in additional guide angles or other devices connecting these two elements in order to ensure the necessary running play. Furthermore, running play is also not impaired if the cam slider or tool warms up, since not only the production tolerances, but also any expansion of the material can be accommodated by the connection via a guiding clamp. The cam slider's stability is therefore neither impaired nor diminished. And despite of the omission of grinding-in, high running precision can be achieved. Moreover, this also reduces the cost of the cam slider considerably, as not only less material is required, but also less effort in the joining together of cam guiding element, cam element and driver element.

The guiding clamp(s) is/are preferably positively engageable or preferably positively engage(s) with the cam guiding element. The cam element is thus suspended via the guiding clamps from the cam guiding element by means of this positive engagement. Consequently, it is no longer necessary to provide retention on the cam guiding element with the aid of screws, which are firstly subject to wear and secondly can bring about the already mentioned impairment of running play on becoming warm. As a result, it is possible to advantageously achieve considerably higher retention forces between the cam element and cam guiding element than are possible with the prior art. Moreover, the service life of the cam slider can be extended several times over.

The at least one guiding clamp preferably has retaining projections by means of which the guiding clamp engages with a part of the cam guiding element, said retaining projections having a slope. The retaining projections can for instance be molded nose-like onto an essentially flat base body of the guiding clamp. In another preferred embodiment they are formed as keys aligned in the longitudinal direction of the guiding clamp and protruding from the flat base body of the clamp. The retaining projections more preferably have a slight slope, in particular a slope of about 1° toward the driver element. This slope is preferably provided only on one side of the retaining projections and permits the linear and parallel displacement of at least one guiding clamp in the direction of stroke of the cam slider. This preferably permits a linear adjustment of the guiding play and/or a setting of the sliding play between the upper and lower guide parts by the guiding clamp(s). The guiding clamp and upper guide part more preferably engage with each other in such a way that a linear displacement of the guiding clamp in the direction of stroke of the cam slider leads to a change in the guiding play transversely to the driver element's direction of action, while the linearity of the guiding play remains essentially constant. Due to the linear adjustment or displacement of the guiding clamp in the direction of stroke of the cam slider, the guiding play thus changes transversely to the driver element's direction of action as a result of the slight slope of in particular 1° without any change in the guiding play's linearity. From the possibility of achieving a linear adjustment of the guiding play, any wear occurring in continuous operation can be advantageously counteracted quickly and hence inexpensively.

Each individual part produced on the tool generally has its own tolerance zone, the cam guiding element only being permitted to have a sliding play of in particular 0.02 mm in this area to achieve the demanded running precision.

Achieving this with cam sliders of the prior art on which it is envisaged that the cam element and cam guiding element are screwed together is very complex and cost-intensive as constant reworking is necessary combined with repeated removal and re-fitting. With the advantageous use of a guiding clamp and as a result of its mere parallel displacement, the sliding play can be advantageously changed, as a result of which the previously necessary individual work steps become superfluous, namely the measuring and grinding-in of the individual elements of the cam slider. Production tolerances can thus be advantageously compensated for, thus yielding considerably lower production costs of the individual parts being produced.

The cam element and cam guiding element preferably have essentially the same width. Furthermore, they preferably have essentially parallel faces on which the at least one guiding clamp is fastenable. This proves to be advantageous as a cam slider should be guided not only in the area of its lower guiding part with a constant sliding play of, for example, 0.02 mm, but also at the sides, which proves to be very complicated with cam sliders of the prior art. By providing guiding clamps in combination with a cam element and cam guiding element of essentially the same width, the complex grinding-in of the faces resting or sliding against each other can firstly be eliminated. Secondly, it is totally immaterial how large the actual width of the cam element and cam guiding element is as long as both elements are essentially equally wide. To achieve the demanded running play or sliding play, only two faces, namely the two parallel faces opposite one another, are provided, to which the guiding clamp is fastened. As a result of the contiguity of the essentially flat base body of the guiding clamp to the outer faces of the cam element and cam guiding element, an adjustment of the two elements is thus achieved, which in turn yields the desired running precision, even in those cases where either the guiding clamp or cam element or cam guiding element is substituted or replaced by a replacement part. Consequently, it is possible to achieve, firstly, inexpensive production and, secondly, equally inexpensive operation of the cam slider.

The lower and/or upper guiding part preferably has a prismatic part and/or at least a prismatic surface to guide the cam element and/or to take up lateral forces for the generation of high running precision. Since the working face of the cam slider preferably extends over the entire width of the cam slider, the prismatic part and/or the prismatic surface can preferably be provided in the lower guiding part to drive and/or to guide the upper guiding part. The bigger the prismatic part and/or the prismatic surface is, the more easily and thus also better the upper guiding part can be driven and guided on it and in particular the cam element can be driven and guided on the driver element. The cam guiding element and/or cam element can also have prismatic faces, in particular faces sliding on each other or faces joinable to each other. The prismatic part/prismatic surface is preferably dimensioned in relation to the dimensions—and particularly the width—and other physical characteristics of the cam element. In this connection, the cam slider preferably has an essentially uniform width over the entire extension of the width. It is thus possible to ideally dimension the prismatic part/prismatic surface in relation to the width of the cam element, which has an enormous effect on the running life and service life of the cam slider. A driver element or cam guiding element or cam element with an especially large prismatic surface or an especially large prismatic part is advantageously capable of receiving larger pressing forces applied vertically, of better withstanding thrust forces by means of its V-shape, and thus improving running precision. Improved running precision combined with greater pressing forces represents an aim of a cam slider. Moreover, by providing prismatic surfaces, a better constant setting is possible. The actual width of the cam slider has an effect on the degree of stability of the driver element. Through the use of the prismatic part/prismatic surface, a further improvement in the running life and service life of the cam slider can thus be achieved, and in particular the compactness of the cam guiding element and cam element achieved through the use of the guiding clamps can be exploited even better for the effective machining of a workpiece.

A spring element, particularly a gas spring, is preferably provided to return the cam element and is secured in the cam element and detachable by means of a securing element, particularly a securing screw. The use of two guiding clamps makes a compact design of the cam slider possible. This in turn makes it possible for a gas spring or another spring element used to return the slide element to be replaced with ease in its assembled state and without necessitating the complete disassembly of the cam slider. Since a gas spring in particular, as well as other spring elements, have to be replaced as wearing parts relatively often during the operation of a press, a punching tool or other tool in which the cam slider is fitted, this easy assembly and disassembly proves to be particularly advantageous as now the complete removal of the cam slider from the tool and the subsequent disassembly of the cam slider are no longer necessary. Particularly advantageously, a securing screw can be released and removed, as a result of which the spring element can also be preferably disassembled in this direction. Advantageously, on the other hand, no further securing measures are necessary to secure the spring element in the cam slider apart from the provision of the securing screw. This not only reduces the cost of materials and effort in production, but also yields an even more compact cam slider design.

The individual cam slider elements sliding on each other are preferably made of a material combination of bronze and hardened steel, particularly in combination with a lubricant, particularly a solid lubricant. In this case, the wearing parts, which have to be replaced more frequently anyway, are made of soft bronze, which wears faster than, for instance, hardened steel. As a result, virtually no wear takes place over an extended period in the cam slider proper, i.e. the elements cam guiding element, cam element and driver element. The only parts that have to be replaced are those provided on the guiding faces, such as wear plates etc. By adjusting the guiding clamps it is possible to compensate for sliding play increased by wear. A particularly advantageous consequence of this is that the expensive grinding-in of the wear parts having to be replaced is no longer necessary. This fact is of exceptional importance particularly for service life, as a cam slider is usually stressed and operated with extremely high pressing forces and thus the guiding faces and wear plates are exposed to high wear.

Positive returns are preferably provided to prevent the action of lateral moments on the cam slider between the driver element and cam element. In this connection, the cam element is thus particularly preferably displaceably connectable or connected to the driver element in such a way that the prismatic part/prismatic surface of the driver element can essentially only be lifted off in its starting position. The provision of two positive returns arranged opposite each other, which are designed in particular as clamps between the cam element and driver element, makes trouble-free further operation possible even in the event of the jamming or immobility of the cam slider without lateral moments acting upon the cam slider. Particularly in automatic operation, stroke rates of 13 to 25 strokes/min are achieved, which is why a temporary disturbance due to the immobility or jamming of the cam slider would be costly. The cam element is employed on the driver element in such a way that the cam element initially has to travel a working distance into its starting position before it can be lifted off the prismatic surface. This prevents the cam element in its forward working position from being pulled upward out of the driver element, which would generally result in the breakage of the forming device, particularly a punching die. The positive return can have a clamp-like design and engage in a corresponding guide member of the driver element, in which case it engages in the cam element preferably with a groove or a similar recess or opening. To exclude the occurrence of biased moments, the cam slider is preferably provided in the relevant area, particularly that of the cam element and driver element, with positive returns on both sides.

A fixed face for creating a reproducible starting position for the cam slider is preferably provided between the cam guiding element and the cam element. For the reproducible adjustment of the cam slider, which has a sloping face that is movable back and forward over two other sloping guiding faces, in a tool the sloping fixed face between the cam slider and its receiving element can be selected as an adjusting face; a spacer, whose dimensions correspond to the desired distance between the adjusting face and a sloping face of the cam slider, said sloping face of the cam slider being at a fixed angle to the sloping face, can be laid on the adjusting face; and the cam slider can be fixed in this position or fastened in the tool. Such a fixed face can be an inner face of the cam guiding element to which the spacer can be joined and the cam element with the spring element can travel against it. The adjusting face preferably serves as a reproducible fixed face for first-time assembly in the tool. However, the fixed face also proves to be particularly advantageous for the constant checking and possible changing of the position of the cam slider. This nay be necessary in particular if the cam slider is continuously driven back and forward during operation, in particular if the cam slider moves a punching die or a mold cheek, as the cam slider then can always be returned to a reproducible point or to a reproducible face and adjusted. A reproducible starting position is therefore yielded. This saves labor considerably compared to the adjustment of a cam slider as described in the prior art. The necessary assembly time for the adjustment and assembly of the cam slider can be reduced with this process by about 80 percent, which also represents a considerable reduction in costs. Further adjustment of the cam element and cam guiding element relative to each other no longer has to be carried out as, if the inventive guiding clamps are used, these two elements are already adjusted relative to each other due to their use. No additional adjustment effort therefore arises if the guiding clamps are used.

For more detailed explanation of the invention, embodiments thereof will now be described in greater detail with reference to the drawings wherein:

BRIEF DESCRIPTION OF THE DRAWINGS

FIG. 3 shows a sectional view through the cam slider according to FIG. 2, in which the cam element on the driver element is at rest in its starting position.

FIG. 4 shows a flow diagram of travel paths during the movement of the cam guiding element, cam element and driver element according to FIGS. 2 and 3.

DETAILED DESCRIPTION OF THE INVENTION

Figure 1:
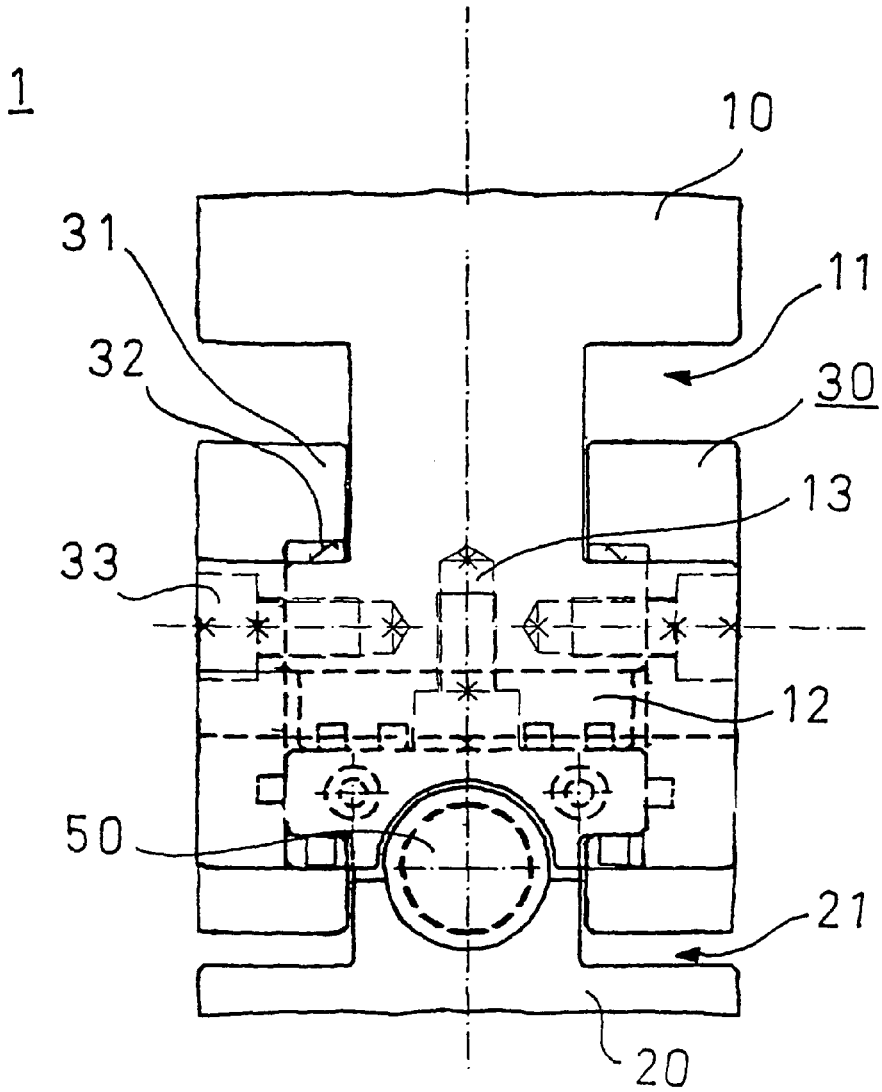
FIG. 1 shows a top view of the inventive cam slider with two guiding clamps.

FIG. 1 shows a top view of a first embodiment of an inventive cam slider 1. This has a cam guiding element 10 and a cam element 20, which are connected together by two guiding clamps 30. To displace the cam element in relation to the cam guiding element, a spring element 50 is also provided. The spring element 50 is embedded in the cam element and is in particular a gas spring. This rests, as can be seen better in FIGS. 2 and 3, on one side against the cam guiding element 10 and on the other side against the cam element 20.

The guiding clamps 30 each have retaining projections 31. The retaining projections 31 are each provided with a slope 32 which is orientated toward the driver element and can be seen better in FIG. 2. The slope is orientated in particular at an angle of 1° toward the driver element. Even in the event of material expansion, this ensures secure retention on the cam guiding element and cam element, constant running play or sliding play and thus the possibility of constantly linear, parallel displacement of the guiding clamps on the cam guiding element and cam element in order to compensate for any wear or any other tolerances that may occur. The retention projections 31 engage with corresponding grooves 11, 21 of the cam guiding element and cam element, as a result of which the guiding clamps fit positively in at least the groove 11 of the cam guiding element in the direction of the clamp. For further fastening of the guiding clamps on the cam guiding element, the clamps are connected together with screws 33. These can either be replaced by other fastening means or be omitted entirely. These preferably permit the movement of the guiding clamps for their adjustment, as can be seen better in FIG. 2.

To ensure the better sliding of the cam element and cam guiding element on each other, between the two elements a wear plate 12 is inserted which is fastened with screws 13 to the cam guiding element. In the area of the guiding clamps 30, the cam guiding element and cam element have essentially the same width, as a result of which smooth contact against the outer faces of the cam guiding element and cam element is possible. In the area outside the grooves 11, 21, the cam guiding element, cam element and the outer faces of the guiding clamps also have essentially the same width and form essentially a level face. As a result of the assembly of the two guiding lamps on the mutually opposite, parallel outer faces of the cam guiding element and cam element, an extremely low sliding or running play of the cam guiding element and cam element against each other can even be achieved, in particular a sliding play of 0.02 mm. This is particularly evident from FIG. 2. This figure shows a sectional view through the cam slider 1, though, unlike the representation in FIG. 1, also showing the driver element 40. FIG. 1 thus shows a top view as indicated by the arrow X. In the representation in FIG. 2, the cam slider is shown in its working position. In this case, the cam element, which has a sloping face 23, along which it is contiguous to the wear plate 12, which also has a sloping arrangement in space, is displaced along the driver element 40 into its working position. In this position, the punching or forming of a workpiece, for example, can be carried out, a corresponding additional device being fastened for this purpose to the side 22 of the cam element 20. The side 22 and the sloping face 23, to which the spring element 50 is contiguous, form an angle $\alpha$, which can assume a value of 40°, for example. This angle is chosen according to the pressing force to be applied and according to the angle of the connecting face to the driver element. It can therefore also assume a value deviating from $\alpha$=40°.

The sloping spring element 50 rests against an inner face 14 of the cam guiding element 10, said inner face being essentially vertical to a wear plate 12, and is supported on the opposite side by a bearing plate 51 and a bearing piece 52 fastened to it, which is screwed into the cam element, in the cam element 20. The purpose of the spring element is to return the cam element to its starting position, which is shown in FIG. 3. A return force can amount, for example, to 800 newtons, and the pressing force, which is applied by the cam guiding element to the cam element, can amount to 3 metric tons. This pressing force is introduced by a corresponding drive device, which is not represented in FIG. 2, into the upper side 15 of the cam guiding element. To this end, a recess 16 and two external through holes 17 are provided. This can be seen from FIG. 6. As a consequence of the connection of the cam guiding element and cam element by means of the guiding clamps 30 and the resultant advantage of the possibility of providing a narrower upper guiding part which contains the cam guiding element and the cam element, even greater forces can be deflected. For instance, if the upper guiding part 10, 20 has a width of 80 mm, a pressing force of 20 to 26 t can be deflected, whereas a deflection of only 3 t is possible with a width of 140 mm according to the prior art. Furthermore, it is possible for the upper guiding part to have a width of only 50 mm, for instance in order to be integrated in a machine in which little space is available for the cam slider. This is not possible with cam sliders of the prior art, as bulky screw joints are provided on these, which necessitate that the cam slider has a certain minimum width.

Figure 2:
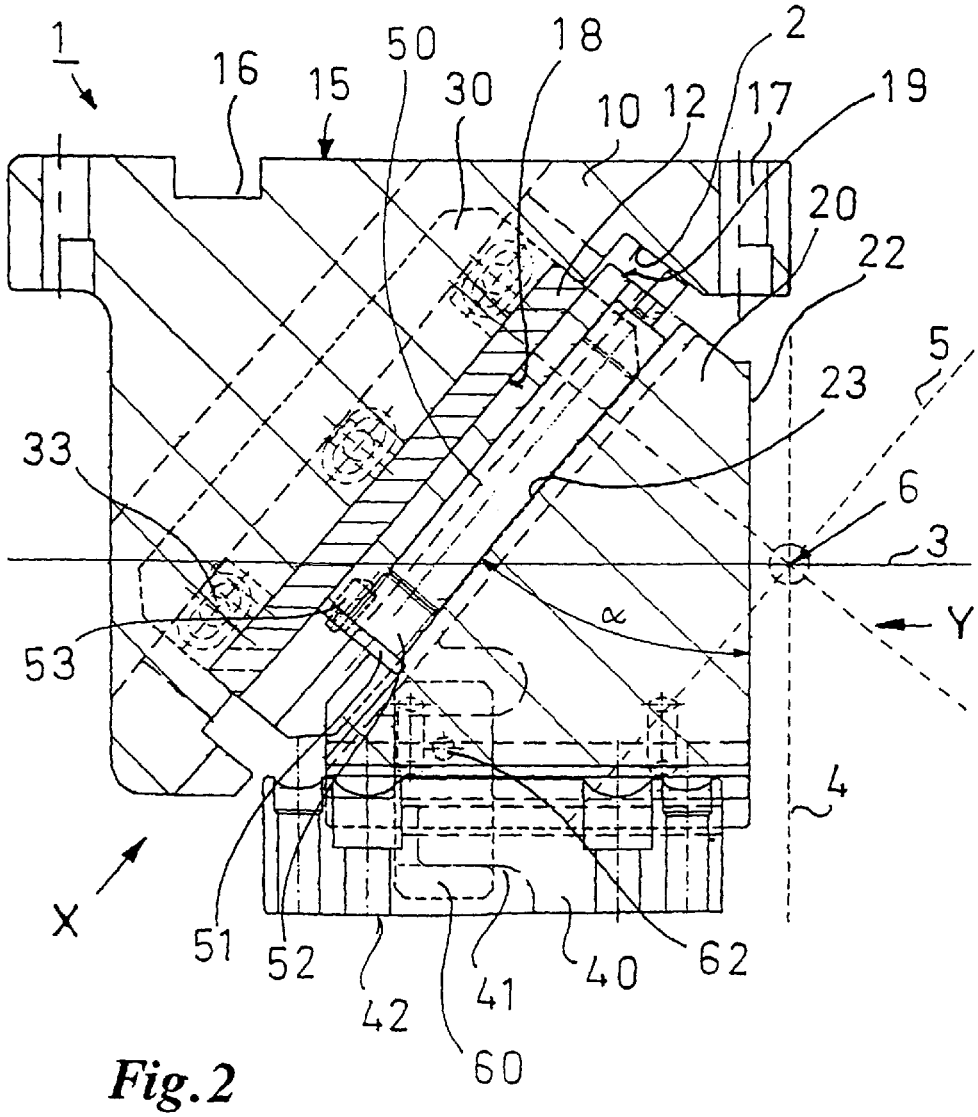
FIG. 2 shows a sectional view through the cam slider according to FIG. 1, in which the cam element on the driver element has been driven into its working position.

To replace the spring element, only the bearing plate 51 has to be released by loosening the screw 53 provided on it and the spring element can be removed. This is preferably performed from direction X, which is indicated in FIG. 2. A new spring element can be inserted in the same direction and secured in the cam element by the bearing plate with the screw 53.

Figure 5:
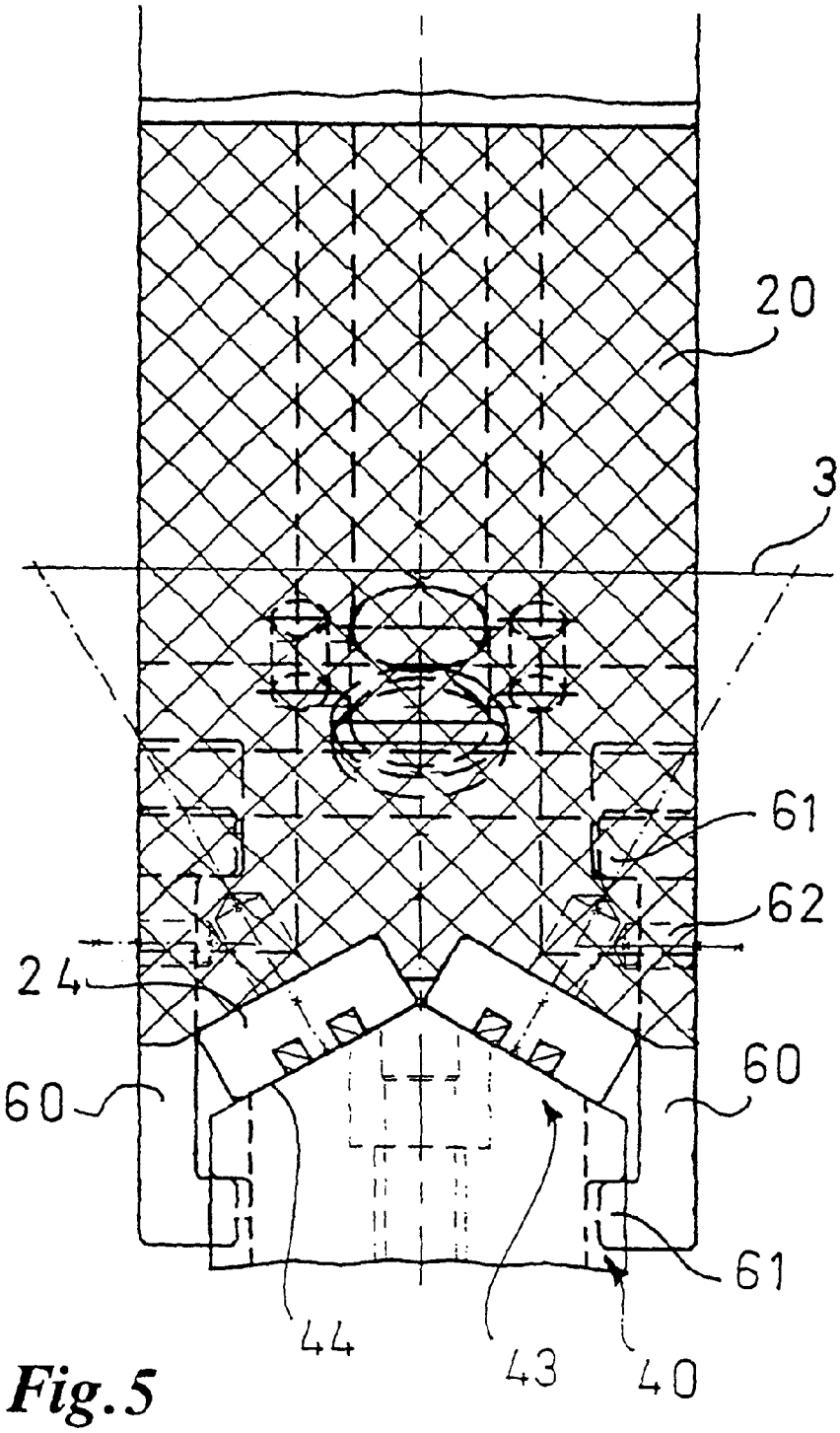
FIG. 5 shows a sectional view through the cam element and driver element with positive returns.

FIGS. 2 and 3 show a driver element 40, along whose surface the cam element is displaced. In order to secure these two elements to each other, particularly in order to prevent the action of lateral moments on the cam slider as a whole in this area, positive returns 60 are provided on both sides. The positive returns, as can be seen better in FIG. 5, are clamp-like and engage both with the cam element and with the driver element with corresponding retaining projections 61. They are firmly connected to the cam element with screws 62. In the driver element a travel member 41 is formed, along which the lower retaining projection 61 of the respective positive return 60 is displaced by means of the movement of the cam element. The upper guiding part, consisting of the cam guiding element and cam element, can only be lifted off the lower guiding part, the driver element 40, in its working position, namely the position of the cam element shown in FIG. 3. Here, the lower retaining projection of the positive return 60 has left the travel member 41, which is why the lifting-off of the upper guiding part from the lower guiding part is possible in this position. This prevents damage to one of the forming or punching devices which is fitted to the side 22 of the cam element; these forming or punching devices are driven in the working position into a workpiece for its machining and could be destroyed failing the possibility of direct detachment. The detachment of the upper guiding part is necessary, for example, in the event of a fault, so that this fault can be remedied as quickly as possible.

In order to subsequently achieve exact positioning and adjustment within the tool after such a lifting-off of the upper guiding part from the lower guiding part, a fixed face 2 is preferably defined in the tool, on the basis of which an adjustment of the cam slider can take place during first-time assembly and during later fitting and removal. Both FIG. 2 and FIG. 3 show this fixed face 2 as well as further lines which have a parallel arrangement with other slopes and horizontal and vertical faces of the upper and lower guiding parts of the cam slider. The fixed face 2 is situated preferably on the contact face of the spring element or cam element. It can also basically be situated on the opposite side of the spring element in the cam guiding element 10, but then the end of the spring element, and not the cam element 20 itself, serves as the contact part. The base face 42 of the driver element is not displaced in height during operation. As can be seen from a comparison of FIGS. 2 and 3, however, the cam guiding element is displaced during operation in terms of its height in relation to the horizontal line 3. The side 22 of the cam element only changes its distance from the vertical line 4 during operation. A line 5 parallel with the sloping face 23 is also formed. The distance of the face 23 from the line 5 preferably does not change during operation. All lines 3, 4, 5 meet at a so-called tooling point 6, which is a standardization part. For the first-time adjustment of the cam slider, a spacer not shown in FIGS. 2 and 3 is employed, which has parallel walls, the distance between which corresponds to the distance between an adjusting or fixed face 2 and the outer face 18 of the cam element 20 in its starting position. The spacer is placed against the sloping fixed face 2 in terms of the outer face 18 and makes it possible to adjust the cam slider in this position, i.e. parallel with the fixed face 2. It is precisely because of the magnitude of the forces to be deflected by the cam slider that precise adjustment should be carried out here.

The travel paths covered during the deflection of the forces by the individual components of the cam slider are shown in FIG. 4. The length a indicates the travel path by which the cam guiding element and cam element are displaced against each other, the length b the travel path by which the pressing force acting upon the cam guiding element displaces it vertically in height, and the length c the travel path by which the cam element is thus displaced along the driver element. The travel path lengths a, b, c can have any desired magnitudes, as a result of which in particular the relative lengths may also differ from those illustrated.

The already above-mentioned FIG. 5 shows a top view of the cam element and part of the driver element in the direction of the arrow Y as shown in FIG. 2. As already mentioned, the cam element and driver element are connected by the positive return 60. Moreover, the cam element runs on a prismatic part 43 of the driver element. To this prismatic part 43 to generate better sliding properties, wear plates 24 are joined, which are fitted to the underside of the cam element 20. The two wear plates 24 are supported on the two flanks 44 of the of the prismatic part 43. The two flanks 44 are arranged at a relatively obtuse angle to each other, thus yielding a relatively large width of running face. This means that a precise guidance of the cam element on the driver element can be achieved. Since, however, the driver element in the illustrated case is narrower than the cam element, although the latter has essentially the same width as the cam guiding element, and the cam element is seated symmetrically on the driver element or its prismatic part, there are no shifts in the force relationships on the two flanks 44, which means that very good uniform running characteristics can be achieved here as well. Lateral thrust forces can also be withstood very effectively and larger pressing forces can be taken up very effectively, even vertically. Owing to the provision of the two guiding clamps on either side of the cam guiding element and cam element and the provision of the spring element centered in the body of the cam element, the pressing forces introduced into the cam guiding element are distributed uniformly over the entire cam slider, so that running precision and smooth running can be optimized during the displacement of the cam element on the prismatic part of the driver element.

As the lateral forces acting precisely upon the cam slider can hinder or at least impair displacement, the fixed face 2 and/or the opposite face 19 are designed in another embodiment as a V-guide. Such a V-guide is particularly good at receiving higher forces. Furthermore, the other guiding faces, particularly guiding face 18 and face 23, can also have a prismatic shape.

Figure 6:
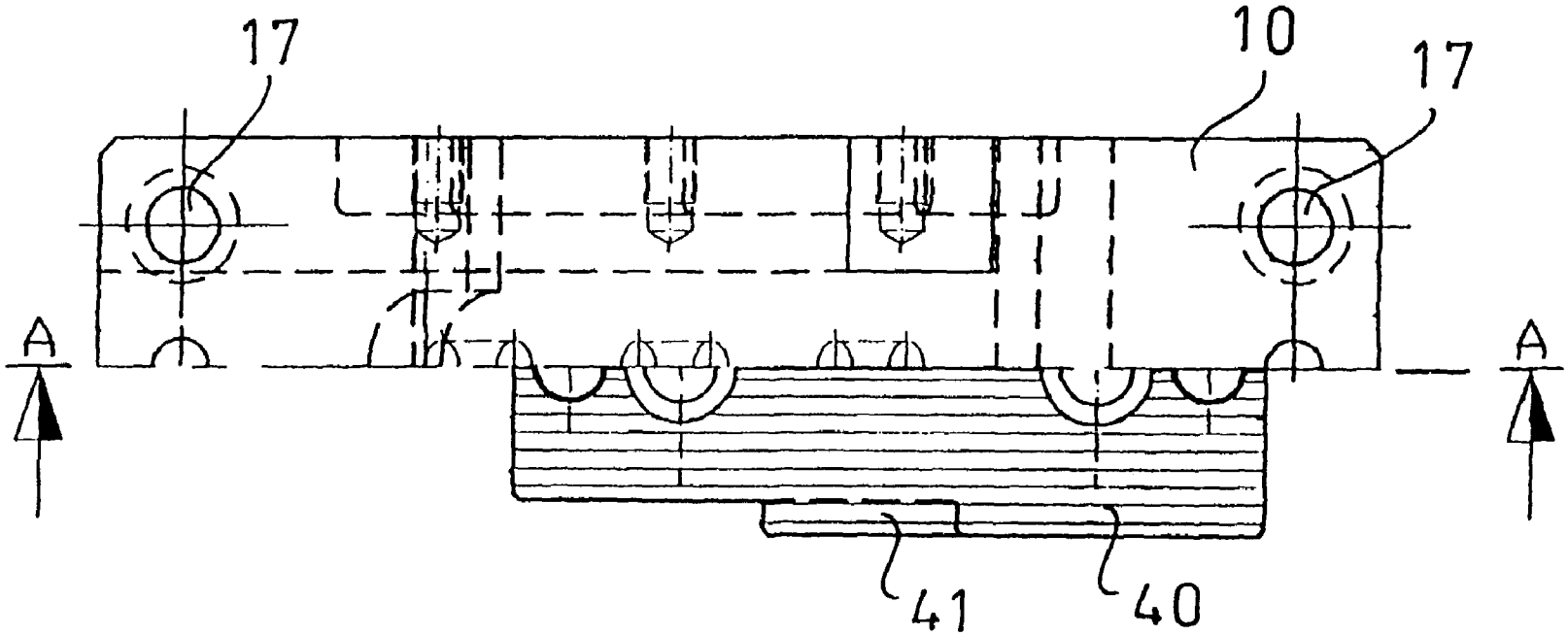
FIG. 6 shows a top view of the cam guiding element in partial section and driver element.

A rough impression of the relative sizes of the cam guiding element and the driver element can be obtained from the sectional top view in FIG. 6. The cam guiding element can be seen in the upper part and the top view of the driver element in the lower part. The section A—A indicated in this figure is presented in FIGS. 2 and 3.

The faces running on each other are preferably made of a material combination of a hard and a soft material, particularly of a combination of soft bronze and hardened steel, with a lubricant, particularly a grease or solid lubricant, particularly oil and graphite, being preferably used between the surfaces. As the wearing parts should be made of the soft bronze or a soft material, the wear plates 18, 24 are made of this material, while the driver element and cam element are preferably made of hardened steel. The guiding clamps 30 are also preferably made of bronze, particularly in order firstly to permit good retention and secondly to provide the desired adjustability in order that the sliding play can be set accordingly.

In addition to the embodiments shown and described in the above figures, numerous other embodiments of cam sliders are still possible, on which in each case the upper guiding part, containing in particular the cam guiding element and cam element, is held together with guiding clamps. The arrangement and other physical design of the cam slider can be freely chosen as long as the advantages resulting from the connection of its elements of the upper guiding parts with guiding clamps are retained. For example, the cam guiding element can also be actuated by a horizontal pressing force, in which case the cam element is then displaced vertically. The provision of guiding clamps proves to be advantageous here as well. However, these can have a different orientation in space and a different shape, which is preferably adapted to the particular case. Guiding clamps can thus be provided independently of an alternative design and travel plane of the cam slider. They permit not only a special stability of the cam slider, but also a compact design, high running precision and the taking-up and generation of high pressing forces. cam sliders with guiding clamps can also be produced inexpensively, as in particular no reworking is necessary as on the prior art for adjustment purposes, which on the prior art is regularly associated with repeated removal and re-fitting of the cam slide and its individual parts, such as the cam guiding element and cam element.

The invention claimed is:

1. A cam slider comprising an upper guiding part comprising a cam element and a cam guiding element, and a lower guiding part comprising a driver element, wherein said upper guiding part is holdable by at least one guiding clamp comprising retaining projections for a linear adjustment of a guiding clearance or play between said upper and lower guiding part, said retaining projections having a slope.

2. The cam slider according to claim 1, wherein said cam element and cam guiding element are held together by at least one guiding clamp.

3. The cam slider according to claim 1, wherein said guiding clamp is engageable positively with the cam guiding element, or the cam element.

4. The cam slider according to claim 1, wherein said at least one guiding clamp has retaining projections by means of which it engages with a part of the cam guiding element, said retaining projections having a slope.

5. The cam slider according to claim 4, wherein said retaining projections have a slight slope, said slight slope being a slope of about 1° toward the driver element.

6. The cam slider according to claim 1, wherein said guiding clamp and the upper guiding part are so engageable with each other that a linear displacement of the guiding clamp in a direction of stroke of said cam slider leads to a change in the guiding play transversely to a direction of action of the driver element, while a linearity of the guiding play remains constant.

7. The cam slider according to claim 1, wherein said cam element and the cam guiding element have the same width and parallel faces, to which the at least one guiding clamp can be fastened.

8. The cam slider according to claim 1, wherein said lower or upper guiding part has a prismatic part or at least a prismatic surface to guide the cam element for generation of high running precision.

9. The cam slider according to claim 1, wherein said cam slider has a uniform width over said cam slider's entire width extension.

10. The cam slider according to claim 1, further comprising one or more fixed faces for generation of a reproducible starting position between the cam guiding element and the cam element.

11. The cam slider according to claim 1 further comprising a spring element and a removable securing element, wherein said spring element is a gas spring to return the cam element, and wherein said removable securing element is a securing screw to secure the cam element.

12. The cam slider according to claim 1, wherein each element sliding on one another are made of a material selected from the group consisting of bronze and hardened steel, wherein said bronze and hardened steel is in combination with a lubricant, said lubricant being a solid lubricant.

13. The cam slider according to claim 8, further comprising positive returns to prevent an action of lateral moments between the driver element and cam element.

14. The cam slider according to claim 8 or 13, wherein said cam element is displaceably connectable to the driver element so that lifting-off from the prismatic part is only possible in a starting position.

15. The cam slider according to claim 1, wherein said guiding clamp comprises retaining projections for a setting of a sliding clearance or play between said upper and lower guiding part, said retaining projections having a slope.

16. The cam slider according to claim 1, wherein said guiding clamp is engageable positively with both the cam guiding element and the cam element.

17. The cam slider according to claim 1, wherein said lower or upper guiding part has at least a prismatic surface to guide the cam element for generation of high running precision.

18. The cam slider according to claim 1, wherein said lower or upper guiding part has a prismatic part to take up lateral forces for generation of high running precision.

19. The cam slider according to claim 1, wherein said lower or upper guiding part has at least a prismatic surface to take up lateral forces for generation of high running precision.

20. The cam slider according to claim 8 or 13, wherein said cam element is connected to the driver element so that lifting-off from the prismatic part is only possible in a starting position.

21. A process for a reproducible adjustment of a cam slider comprising a sloping face, which is movable back and forward over two additional sloping guiding faces in a tool, said process comprising:

selecting an adjusting face comprising a sloping fixed face between the cam slider and said cam slider's receiving element in the tool, laying on the adjusting face a spacer, whose dimensions correspond to a desired distance between the adjusting face and a first sloping face of the cam slider, said first sloping face of the cam slider being at a fixed angle to a second sloping face, and fixing the or fastening the in the tool.

* * * * *